United States Patent [19]

Bright

[11] 4,119,226

[45] Oct. 10, 1978

[54] METHOD FOR PREVENTING COAL SPILLS

[75] Inventor: Robert Harding Bright, Pittsburgh, Pa.

[73] Assignee: Koppers Company, Inc., Pittsburgh, Pa.

[21] Appl. No.: 855,586

[22] Filed: Nov. 29, 1977

Related U.S. Application Data

[63] Continuation of Ser. No. 742,585, Nov. 17, 1976, abandoned.

[51] Int. Cl.[2] ..... B65G 67/06

[52] U.S. Cl. ..... 214/152; 214/41 R

[58] Field of Search ..... 214/18 PH, 41, 152

[56] References Cited

U.S. PATENT DOCUMENTS 1,734,686 11/1929 McCollum et al. ..... 214/41

2,317,175 4/1943 Burdick ..... 214/41

3,066,809 12/1962 Burridge et al. ..... 214/41

*Primary Examiner*—Robert G. Sheridan

*Attorney, Agent, or Firm*—R. Lawrence Sahr; Oscar B. Brumback

[57] ABSTRACT

Slidable gates controlling the flow of coal from a coal bunker into hoppers on a larry car are opened, and simultaneously electric power to the travel circuit of the larry car is interrupted through control circuitry. Also, simultaneously a signal from a transmitter is received by a receiver and an interlock system is activated that prevents power from being restored to the travel circuit larry car until the gates are closed. When the gates are closed, the signal does not reach the receiver and all circuits return to normal and electric power to the travel circuit of the larry car is restored.

4 Claims, 3 Drawing Figures

METHOD FOR PREVENTING COAL SPILLS

This is a continuation, of application Ser. No. 742,585, filed Nov. 17, 1976, abandoned.

BACKGROUND OF THE INVENTION

1. Field of the Invention

The present invention relates to coke oven batteries and, more particularly, to an electro-mechanical interlock system for the gates on the usual coal bunker and the controls for operating the larry car along the top of the coke oven battery.

2. Description of the Prior Art

It is customary to provide a large coal bunker at one end of a coke oven battery that is supplied with coal by a belt conveyor carrying coal from a coal pile, located at some distance from the battery, to the coal bunker. The coal bunker is so designed that the conventional larry car can be located under the coal bunker from which coal is discharged into the coal hoppers on the larry car.

The coal bunker usually has a number of discharge gates, equal to the number of coal hoppers on the larry car, that are shear gates of the counterweighted type. Most of the in-service conventional larry cars have a travel control circuit interlocked with a loading rack on the larry car that opens the bunker gates when the larry car is properly spotted under the bunker. Thus, the larry car, in theory at least, cannot travel as long as the loading rack and the bunker gates are in the open position.

Despite the fact that the loading rack may be interlocked with the travel circuit of the larry car, the loading rack can be closed and the larry car can move while the bunker gates are still open. This results in a major coal spillage. These major coal spills generally result in the loss of production in the battery and in a very costly cleanup project.

Some operators of coke oven batteries have tried various devices to prevent the travel of the larry car while the bunker gates are open. Such devices have included mechanical limit switches on the gate frame to shut off the electrical power to the larry car while the gates are open. But, despite such preventive devices that have tried, major coal spills still are a serious problem in coke oven battery operations.

Usually the major coal spills occur because (1) the gates do not close because a counterweight is used and it is not a reliable device to move the gates from open to closed position; (2) the design of "dogs" on the loading rack and the gate frame make it easy for the loading rack "dog" to slip past the "dog" on the gate frame without closing the gates; and (3) the difference in vertical height of a loaded larry car compared to an empty larry car makes it practically impossible to maintain limit switch connection between the gate frame and the larry car.

Those skilled in the art will recognize, however, from the following description of one embodiment of the present invention how it ensures a proper interlock between the bunker gates and the electrical travel control circuit of the larry car, and thereby avoids such costly coal spills.

SUMMARY OF THE INVENTION

A method for preventing coal spills at a coke oven coal bunker includes spotting the larry car at the bunker and opening a flow control device on the bunker to allow coal to flow into hoppers on the larry car. Simultaneously, electric power to the travel circuit of the larry car is interrupted and an interlock circuit is energized, whereby electric power to the travel circuit of the larry car is not restored until the flow control device is closed. When the flow control device is closed, electric power is again restored to the travel circuit of the larry car which is mobile again.

For a further understanding of the invention and for features and advantages thereof, reference may be made to the following description and the drawings which illustrate a preferred embodiment of equipment in accordance with the invention, for practicing the method of the invention.

DETAILED DESCRIPTION

Figure 1:
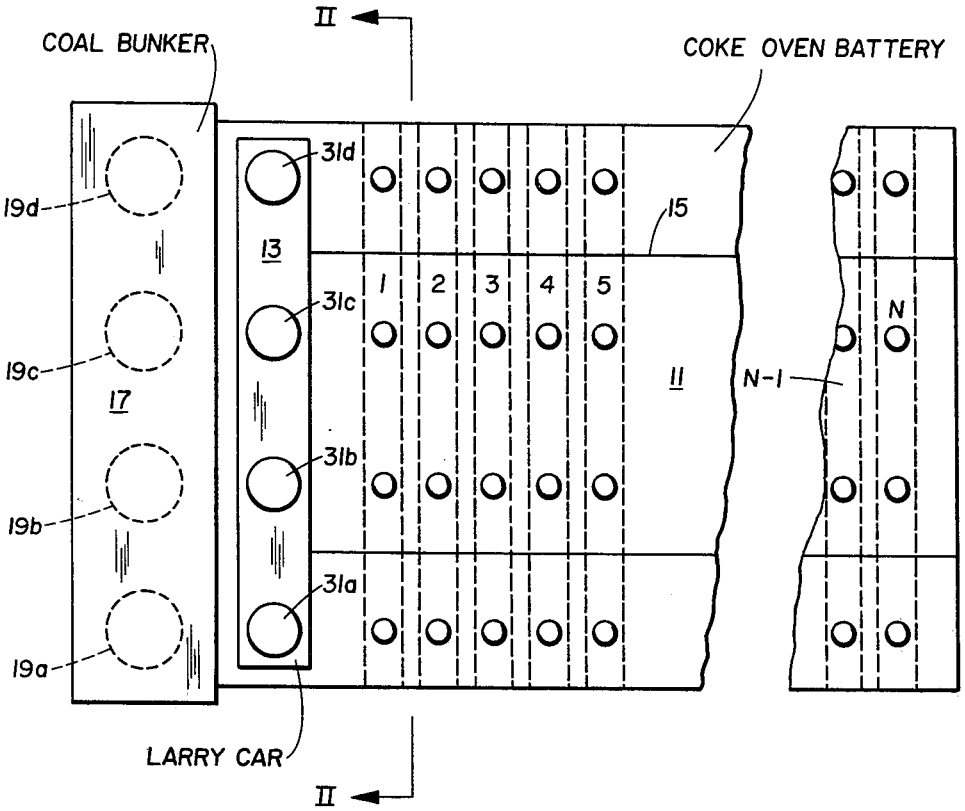
FIG. 1 is a schematic plan view of a coke oven battery showing the relation of a coal bunker to a larry car and coke oven chambers of the battery.

Referring to FIG. 1, a coke oven battery II is shown as comprising N ovens, and at one end there is shown a conventional larry car 13 that travels on rails 15 on top of the battery 11. At the left-hand end, as shown in FIG. 1, of the coke oven battery 11, there is a coal bunker 17 that is a large receptacle for coal, supplied to it in a conventional manner.

Figure 2:
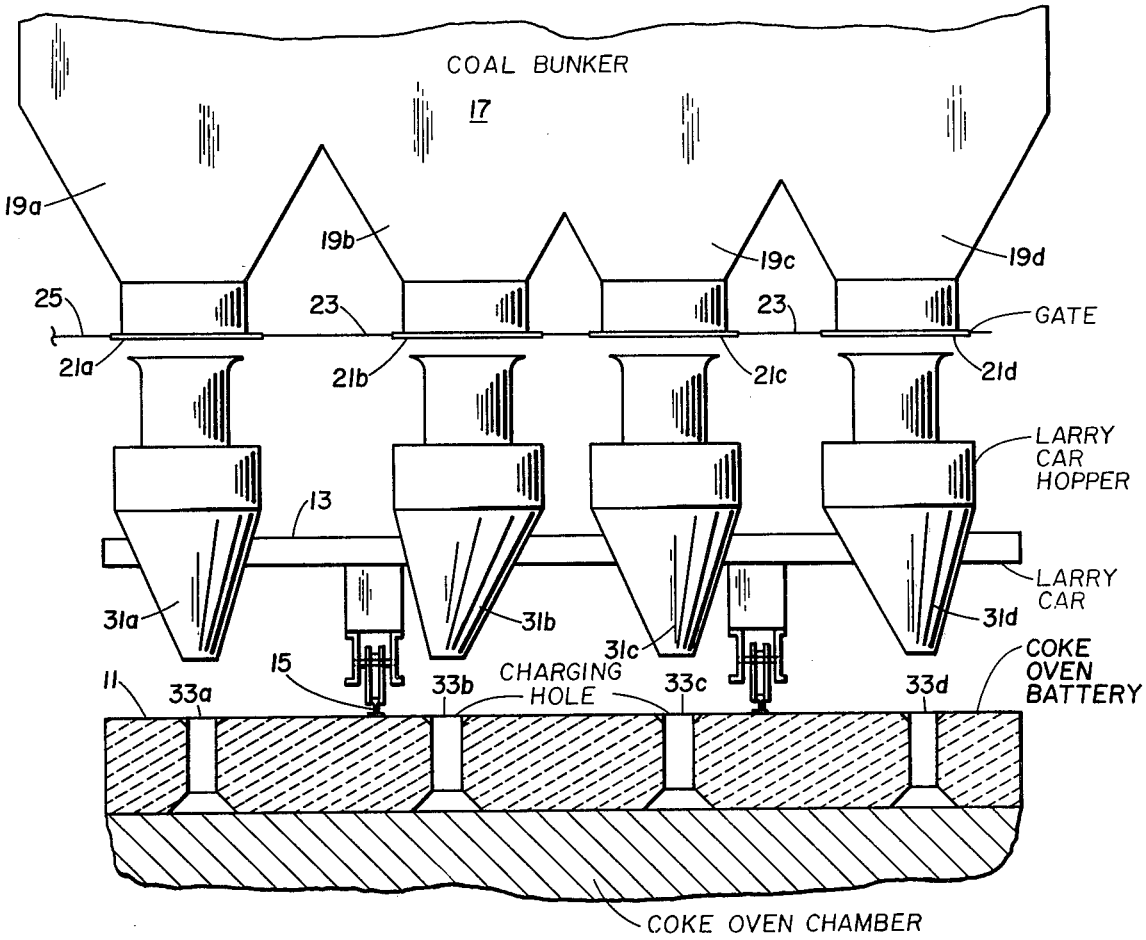
FIG. 2 is a view along line II—II of FIG. 1.
Figure 3:
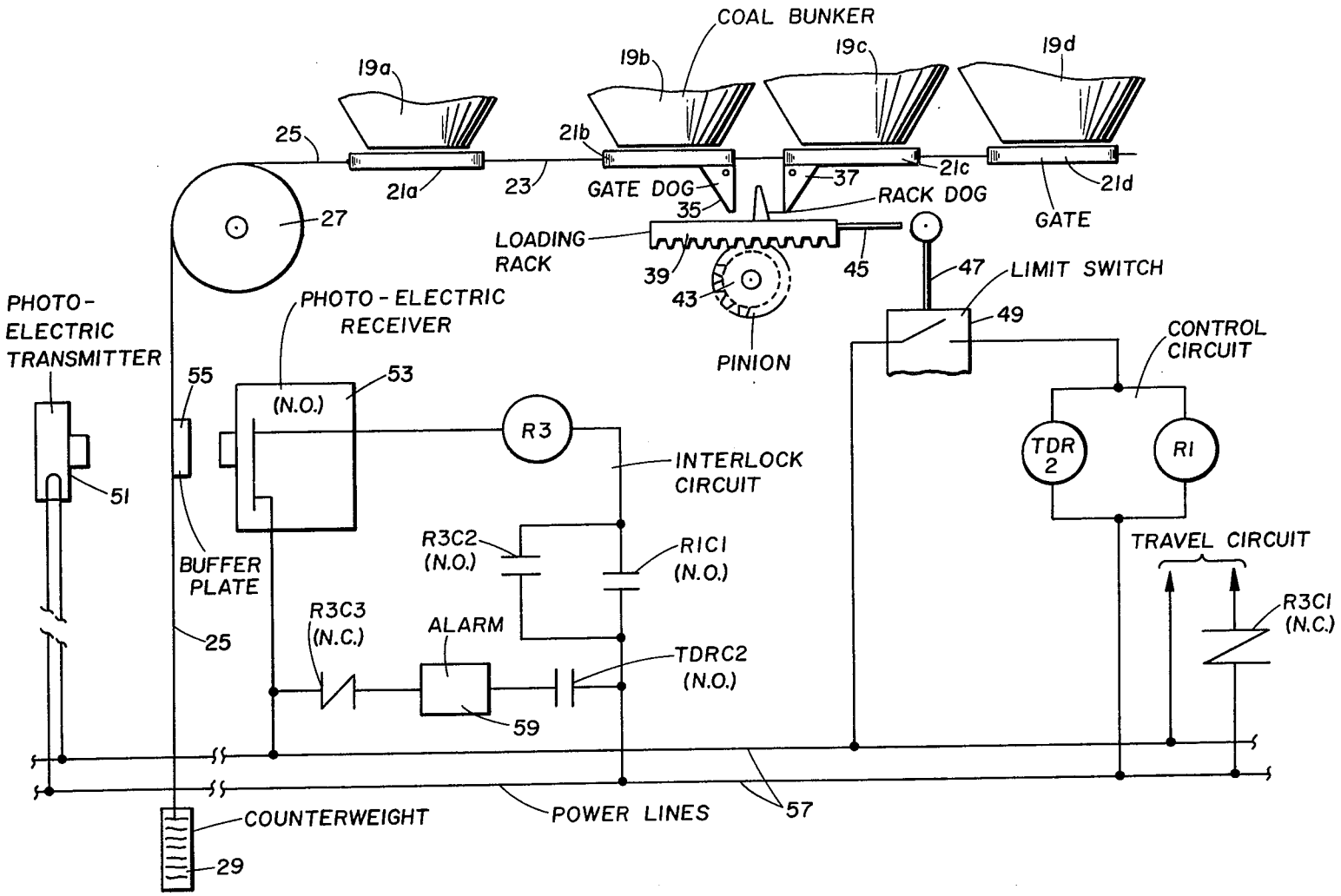
FIG. 3 is a schematic electrical circuit diagram illustrating an embodiment of the present invention.

As shown in FIG. 2, the coal bunker has four discharge funnels **19*a*, 19*b*, 19*c* and 19*d*, and the discharge funnels are provided with slidable closures or gates 21*a*, 21*b*, 21*c* and 21*d*. The four slidable closures or gates are interconnected by means of rods 23 or the like rigid connectors, and a wire rope 25 is connected in a conventional manner to gate 21*a*, as shown in FIG. 3. The wire rope 25 cooperates with a sheave 27 and is connected to a counterweight 29**.

The larry car 13 is provided with four coal hoppers **31*a*, 31*b*, 31*c* and 31*d*, which are positioned in line with the four charging holes 33*a*, 33*b*, 33*c* and 33*d* in each one of the coke oven chambers 1, 2, 3—N-1**, N.

Referring to FIG. 3, it shows schematically a pair of gate dogs 35, 37 connected to gates **21*b* and 21*c*, respectively. In actual practice, however, the gate dogs 35, 37 would be spaced quite close together, and they would be secured to the rods 23 or the like rigid connectors that move the gates 21*a*, 21*b*, 21*c*, 21*d* in the manner described hereinafter. As shown, the gate dogs 35, 37** are pivotally mounted to the structure.

Beneath the gate dogs 35, 37 there is shown a loading rack 39 on which is mounted a rack dog. The loading rack 39 is mounted on the larry car in actual practice (FIG. 3 is a schematic showing) and the rack dog coacts with the gate dogs 35, 37. The gate dogs 35, 37 are pivotable so as to allow the rack dog to move from a position not between the gate dogs to the position between the gate dogs, as shown in FIG. 3. Associated operatively with the loading rack 39 is a powered pinion 43. The loading rack 39 also carries a probe 45 that projects outwardly from it so as to coact with a lever portion 47 of a limit switch 49.

Mounted to a wall of the coal bunker 17, at a convenient location, is a signal or photo-electric transmitter 51 which is directionally oriented toward a signal receiver or photo-electric receiver 53 mounted to the larry car 13. Between the signal or photo-electric transmitter 51 and the signal or photo-electric receiver 53 is a buffer plate 55 that is attached to and that moves with the wire rope cable 25.

In service, after the larry car 13 has discharged its load of coal into an empty coke oven chamber, the larry car 13 moves on the rails 15 to a spot beneath the coal bunker 17. The pinion 43 may then be rotated by an electric motor (not shown) under the control of the larry car operator. The loading rack 39 and the rack dog move to the right (as shown in FIG. 3) so as to engage the rack dog with the gate dog 37. The gates 21*a*, 21*b*, 21*c* and 21*d* then slide laterally toward the right to an open position. As the loading rack 39 moves toward the right (FIG. 3) the probe 45 contacts the lever 47 of the normally open limit switch 49, and closes it.

The limit switch 49 is in a control circuit with a relay R1 and a time delay relay, TDR2, receiving electric power from power lines 57.

When the limit switch 49 closes, both R1 and TDR2 are energized. Relay R1 closes the normally open contactors R1C1 which are in an interlock electrical circuit, also receiving power from the lines 57.

As the bunker gates 21*a*, 21*b*, 21*c* and 21*d* move laterally to the open position, the buffer plate 55 is raised. Then a signal from the transmitter 51 is received by the receiver 53 and the interlock circuit is energized. Relay R3 is then energized, and the normally open contactors R3C2 close, thereby locking in the interlocking circuit. R3 also opens normally closed (N.C.) contactors R3C1, thereby shutting off the electric power to the larry car travel circuit. R3 also opens normally closed contactors R3C3.

If there is a malfunction of the photo-electric transmitter 51, or if the photo-electric receiver 53, R3 should not be energized, R3C3 contactors would remain closed; the time delay relay, TDR2, would time out; and normally open contactors TDR2C would close, sounding an audible and/or visible alarm 59. The alarm warns the larry car operator that the bunker gates 21*a*, 21*b*, 21*c* and 21*d* are still open. Nevertheless, the power supply to the larry car travel circuit has not been cut off. The larry car operator knows then that he must not try to move the larry car.

Now, assuming there is no malfunction in the circuitry and apparatus, when the larry car is loaded, the pinion 43 is rotated so that the bunker gates 21*a*, 21*b*, 21*c* and 21*d* close. As the loading rack moves to the left, as viewed in FIG. 3, the limit switch 49 opens; the gates move to the closed position; and the buffer plate 55 moves to a position between the signal or photo-electric transmitter 51 and the signal or photo-electric receiver 53, where shown in FIG. 3. Then, R1, TDR2 and R3 are de-energized, thereby returning all contactors to their normal position, and providing power to the larry car travel circuit.

Should the loading rack move to the left and in some manner fail to close the bunker gates, the limit switch 14 will close, but electric power will not be restored to the larry car travel circuit because the signal or photo-electric transmitter is still energizing the signal or photo-electric receiver; the buffer plate being in the raised position. When R1 is de-energized by the opening of the limit switch 49, contactors R1C1 open, but R3 is still energized since the interlock circuit is locked in by contactors R3C2. Thus, R3C1 contactors remain open and the larry car travel circuit does not receive power from the power lines. The larry car then cannot move.

From the foregoing description of one embodiment of the invention, those skilled in the art should recognize many important features and advantages of it, among which the following are particularly significant:

That the invention provides a means for interlocking the travel circuit of a larry car with the coal bunker gates without a direct mechanical or physical contact, thereby providing positive assurance that the bunker gates are closed before the larry car can move from beneath the coal bunker; and That the interlock of the present invention is effected by a signal produced by the opening of the coal bunker gates and transmission of this signal to the travel circuit of the larry car does not require any physical contact between the larry car and the bunker gate mechanism.

While the embodiment of the invention illustrated in the drawings and described herein includes a photo-electric transmitter and a photo-electric receiver, for transmitting a signal from the coal bunker gate mechanism to the larry car, those skilled in the art will recognize that other signal transmitting means may be used if preferred. Such other means may include light beams, magnetic proximity switches and air streams. Also, the circuit on the larry car that receives the signal and controls the supply of power to the larry car travel circuit may include various alarms, fail-safe circuits and the like, that one skilled in the art may prefer to use.

Although the invention has been described herein with a certain degree of particularity it is understood that the present disclosure has been made only as an example and that the scope of the invention is defined by what is hereinafter claimed.

What is claimed is:

1. A method for preventing coal spills when coal is being loaded from a coal bunker, fitted with a coal flow control means, into hoppers of an electrified coal larry car which includes a travel circuit operative on a horizontal coke oven battery, comprising:

(a) spotting said larry car in relation to said coal bunker for receiving coal therefrom;

(b) opening said flow control means whereby coal is loaded, by gravity flow, from said bunker into said hoppers;

(c) actuating, by said operation of said flow control means, a limit switch in a control circuit whereby said electrified coal larry car is de-energized;

(d) effecting, by said operation of said flow control means, the transmission of a light signal to a photo-electrical receiver;

(e) actuating, by said photo-electrical receiver, when said receiver receives said transmission of said light signal, of an interlock circuit which prevents re-energization of said electrified coal larry car, said interlock circuit which can only be de-actuated by the closing of said flow control means; and (f) closing said flow control means when said hoppers are fully loaded, said closing which substantially concurrently de-actuates said interlock circuit and de-actuates said limit switch thereby re-energizing said electrified coal larry car.

2. The invention of claim 1 further comprising activating a signal, perceptible by the operation of said electrified coal larry car, when said flow control means fails to close at such point when said hoppers are fully loaded.

3. The invention of claim 1 wherein said effecting the transmission of a light signal to a photo-electrical receiver comprises moving a light blocking means out of the path of said light signal to said photo-electrical receiver by the operation of said flow control means.

4. The invention of claim 3 wherein said blocking means is a buffer plate which is pulled out of the path of said light signal to said photo-electrical receiver by the operation of said flow control means through movement of a cable attached to said buffer plate at one end and said flow control means at the other end.

* * * * *